US009406989B2

(12) United States Patent
Hino

(10) Patent No.: US 9,406,989 B2
(45) Date of Patent: Aug. 2, 2016

(54) TWO-PORT NON-RECIPROCAL CIRCUIT ELEMENT

(71) Applicant: Murata Manufacturing Co., Ltd., Nagaokakyo-shi, Kyoto-fu (JP)

(72) Inventor: Seigo Hino, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/754,866

(22) Filed: Jun. 30, 2015

(65) Prior Publication Data

US 2015/0303544 A1 Oct. 22, 2015

Related U.S. Application Data

(63) Continuation of application No. PCT/JP2014/050418, filed on Jan. 14, 2014.

(30) Foreign Application Priority Data

Jan. 24, 2013 (JP) ..... 2013-011019

(51) Int. Cl.
*H01P 1/36* (2006.01)

(52) U.S. Cl.
CPC ..... *H01P 1/36* (2013.01)

(58) Field of Classification Search
CPC ..... H01P 1/32; H01P 1/36; H01P 1/38; H01P 1/383
USPC ..... 333/1.1, 24.2
See application file for complete search history.

(56) References Cited

U.S. PATENT DOCUMENTS

2007/0030089 A1 2/2007 Hino
2011/0204989 A1* 8/2011 Wada ..... H01P 1/387 333/1.1

FOREIGN PATENT DOCUMENTS

JP 4197032 B2 12/2008
JP 2011-146987 A 7/2011

OTHER PUBLICATIONS

Official Communication issued in International Patent Application No. PCT/JP2014/050418, mailed on Apr. 8, 2014.

* cited by examiner

*Primary Examiner* — Stephen E Jones
(74) *Attorney, Agent, or Firm* — Keating & Bennett, LLP

(57) ABSTRACT

A two-port non-reciprocal circuit element includes a ferrite, a first central electrode disposed on the ferrite and including an end connected to an input port and another end connected to an output port, a second central electrode disposed on the ferrite so as to intersect the first central electrode while being electrically insulated from the first central electrode, the second central electrode including an end connected to the input port and another end connected to a ground port, a capacitor connected between the input port and the output port, a resistor connected between the input port and the output port, a capacitor connected between the output port and the ground port, an input terminal, and an output terminal. A capacitor is connected at least between the input port and the input terminal or between the output port and the output terminal, and a capacitor and an inductor are connected in series between the input terminal and the output terminal.

5 Claims, 5 Drawing Sheets

TWO-PORT NON-RECIPROCAL CIRCUIT ELEMENT

BACKGROUND OF THE INVENTION

1. Field of the Invention

The present invention relates to two-port non-reciprocal circuit elements, and more specifically to a two-port non-reciprocal circuit element such as an isolator preferably for use in a microwave band.

2. Description of the Related Art

Non-reciprocal circuit elements such as isolators or circulators generally have a characteristic of transmitting a signal only in a predetermined specific direction and not transmitting a signal in the opposite direction. With the use of this characteristic, for example, an isolator is used in a transmission circuit unit of a wireless communication system such as a cellular phone.

A known two-port non-reciprocal circuit element of this type is described in Japanese Patent No. 4197032. The described two-port isolator includes a ferrite to which a direct-current magnetic field is applied by a permanent magnet, a first central electrode and a second central electrode which are disposed on the ferrite so as to be insulated from each other, a first capacitor electrically connected between an input port and an output port, a resistor electrically connected between the input port and the output port, a second capacitor electrically connected between the output port and a ground port, an input terminal, and an output terminal. An impedance matching capacitor is electrically connected at least between the input port and the input terminal or between the output port and the output terminal, and a coupling capacitor is electrically connected between the input terminal and the output terminal.

The coupling capacitor is configured to adjust an insertion loss characteristic and an isolation characteristic using the trade-off between them. However, the coupling capacitor has an impedance that decreases as the operating frequency increases, and thus, at a high operating frequency, the input port and the output port are substantially directly coupled to each other in a harmonic frequency band, resulting in it being difficult to obtain a desired harmonic attenuation. In the future, it is expected to implement a wireless communication system for high-frequency applications, and the problem described above is considered to become serious. Adding a trap circuit enables an improvement in harmonic attenuation, whereas the complexity of a structure or a circuit increases. There is also a problem of degradation in insertion loss.

SUMMARY OF THE INVENTION

Preferred embodiments of the present invention provide a two-port non-reciprocal circuit element capable of achieving a good insertion loss characteristic and a good harmonic attenuation characteristic without significantly increasing the complexity of a structure or a circuit.

A two-port non-reciprocal circuit element according to a first aspect of various preferred embodiments of the present invention includes a permanent magnet, a ferrite to which a direct-current magnetic field is applied by the permanent magnet, a first central electrode disposed on the ferrite and including an end electrically connected to an input port and another end electrically connected to an output port, a second central electrode disposed on the ferrite so as to intersect the first central electrode while being electrically insulated from the first central electrode, the second central electrode including an end electrically connected to the output port and another end electrically connected to a ground port, a first capacitor electrically connected between the input port and the output port, a resistor electrically connected between the input port and the output port, a second capacitor electrically connected between the output port and the ground port, an input terminal, and an output terminal, wherein an impedance matching capacitor is electrically connected at least between the input port and the input terminal or between the output port and the output terminal, and a coupling capacitor and a coupling inductor are connected in series between the input terminal and the output terminal.

In a second aspect of various preferred embodiments of the present invention, the coupling capacitor and the coupling inductor may be connected in series between the input terminal and the output port.

In a third aspect of various preferred embodiments of the present invention, the coupling capacitor and the coupling inductor may be connected in series between the input port and the output terminal.

In the two-port non-reciprocal circuit element described above, a series circuit including the coupling capacitor and the coupling inductor and the first capacitor define a parallel resonant circuit, and the parallel resonant circuit has a high impedance around a resonant frequency. For this reason, matching the resonant frequency of the parallel resonant circuit to a harmonic frequency which requires attenuation achieves a good harmonic attenuation characteristic. In addition, since the coupling capacitor is connected in parallel to the first capacitor, a good insertion loss characteristic is achieved. The impedance of the coupling inductor is small enough to be negligible around the operating center frequency, with substantially no degradation in insertion loss.

In the two-port non-reciprocal circuit element described above, furthermore, only the addition of the coupling inductor will not result in an increase in the complexity of a structure or a circuit. Additionally, since the coupling inductor is connected in series to the coupling capacitor, the coupling capacitor is sufficient to have a small capacitance value, leading to a reduction in the size of the coupling capacitor.

According to various preferred embodiments of the present invention, it is possible to achieve a good insertion loss characteristic and a good harmonic attenuation characteristic without significantly increasing the complexity of a structure or a circuit.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 6A and 6B are graphs illustrating the characteristics of the two-port non-reciprocal circuit element according to the first exemplary embodiment, in which FIG. 6A illustrates a harmonic attenuation characteristic and FIG. 6B illustrates an insertion loss characteristic.

DETAILED DESCRIPTION OF THE PREFERRED EMBODIMENTS

Two-port non-reciprocal circuit elements according to exemplary embodiments of the present invention will be described hereinafter with reference to the accompanying drawings.

Figure 1:
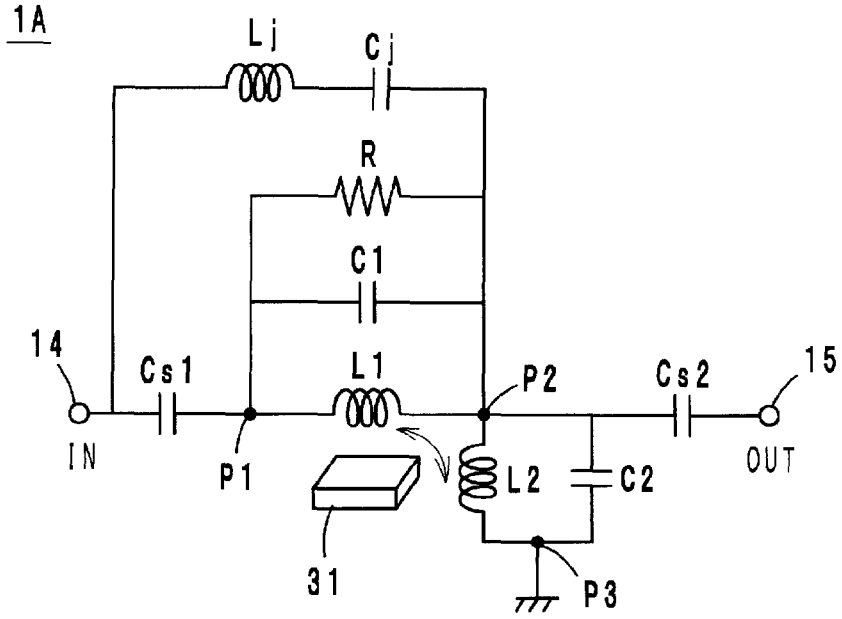
FIG. 1 is an electrical equivalent circuit diagram illustrating a two-port non-reciprocal circuit element according to a first exemplary embodiment of the present invention.
Figure 2:
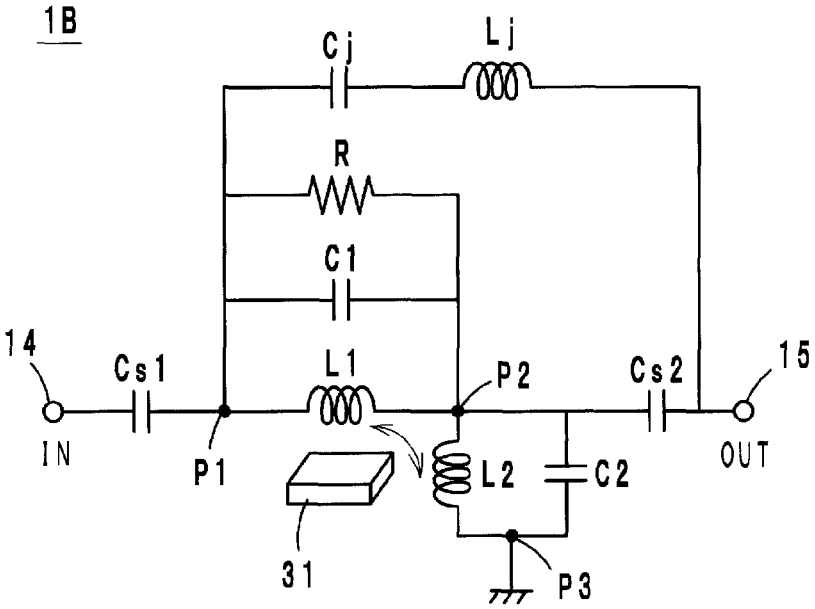
FIG. 2 is an electrical equivalent circuit diagram illustrating a two-port non-reciprocal circuit element according to a second exemplary embodiment of the present invention.
Figure 3:
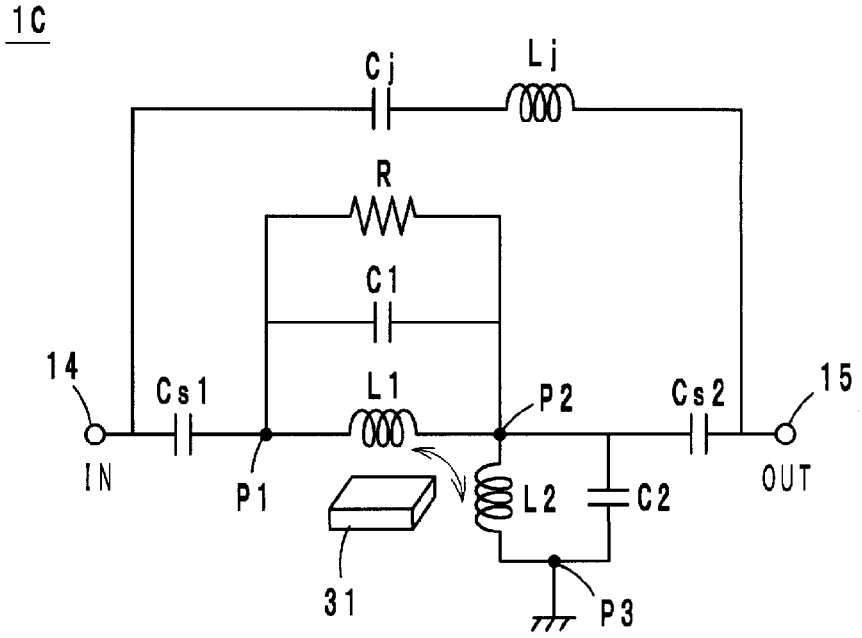
FIG. 3 is an electrical equivalent circuit diagram illustrating a two-port non-reciprocal circuit element according to a third exemplary embodiment of the present invention.

FIG. 1 to FIG. 3 illustrate equivalent circuits of two-port non-reciprocal circuit elements according to first to third exemplary embodiments. The illustrated two-port non-reciprocal circuit elements are lumped-constant isolators.

A two-port isolator 1A according to the first exemplary embodiment illustrated in FIG. 1 includes a first central electrode L1 including an end electrically connected to an input port P1 and another end electrically connected to an output port P2. A second central electrode L2 includes an end electrically connected to the output port P2 and another end electrically connected to a ground port P3. A resonance capacitor C1 and a terminating resistor R are connected electrically in parallel between the input port P1 and the output port P2. A resonance capacitor C2 is electrically connected between the output port P2 and the ground port P3. Matching capacitors Cs1 and Cs2 are electrically connected between the input port P1 and an input terminal 14 and between the output port P2 and an output terminal 15, respectively, to match impedances. A coupling capacitor Cj and a coupling inductor Lj are further electrically connected in series between the input terminal 14 and the output port P2.

Further, the first central electrode L1 and the resonance capacitor C1 define a parallel resonant circuit between the input port P1 and the output port P2. The second central electrode L2 and the resonance capacitor C2 define a parallel resonant circuit between the output port P2 and the ground port P3.

A two-port isolator 1B according to the second exemplary embodiment illustrated in FIG. 2 is configured such that the coupling capacitor Cj and the coupling inductor Lj are electrically connected in series between the input port P1 and the output terminal 15, and the other configuration is similar to that in the first exemplary embodiment.

A two-port isolator 1C according to the third exemplary embodiment illustrated in FIG. 3 is configured such that the coupling capacitor Cj and the coupling inductor Lj are electrically connected in series between the input terminal 14 and the output terminal 15, and the other configuration is similar to that in the first exemplary embodiment.

Figure 5:
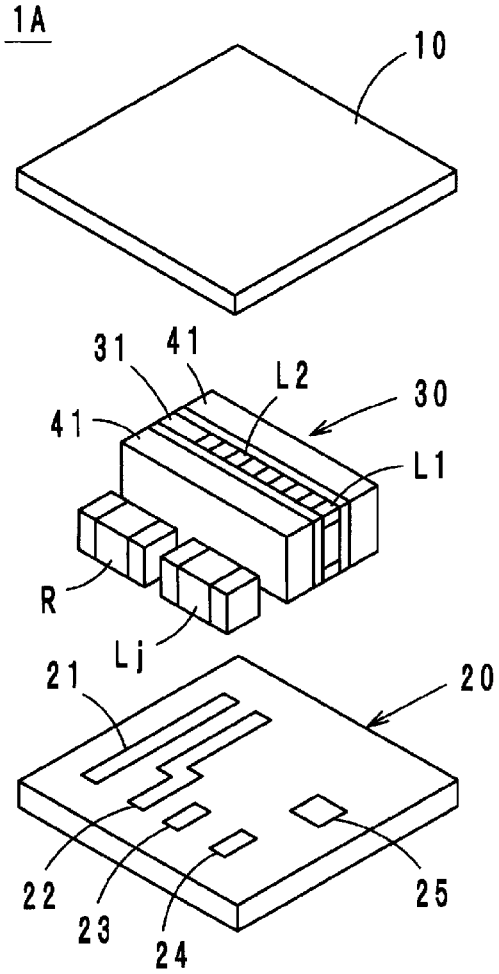
FIG. 5 is an exploded perspective view of a two-port non-reciprocal circuit element.

FIG. 5 illustrates a schematic configuration of the isolator 1A, and the isolator 1A preferably includes at least a yoke 10, a multilayer substrate 20, a central electrode assembly 30 including a ferrite 31, and permanent magnets 41 to apply a direct-current magnetic field to the ferrite 31. The central electrode assembly 30 is configured such that the first central electrode L1 and the second central electrode L2, which are electrically insulated from each other, are disposed on front and rear surfaces of the microwave ferrite 31 having a rectangular or substantially rectangular parallelepiped shape. A specific configuration of the central electrode assembly 30 is described in detail in, for example, Japanese Patent No. 4197032, and is well known so that it is not described here.

The coupling inductor Lj and the terminating resistor R each include a chip-type element. The other capacitors are incorporated into the multilayer substrate 20. The multilayer substrate 20 is constructed by sintering a stack of a plurality of dielectric sheets on which electrodes having a predetermined shape, which define various capacitors, and interlayer connection conductors (via-hole conductors) are provided. The multilayer substrate includes, on a front surface thereof, electrodes 21 to 25, and, on a rear surface thereof, electrodes defining and functioning as the input terminal 14 and the output terminal 15 and a ground electrode (not illustrated in FIG. 5). The inductor Lj and the terminating resistor R, which are illustrated as chip-type elements in FIG. 5, may be incorporated into the multilayer substrate 20, and the other capacitors may be configured as chip-type elements.

Prior to connecting the coupling capacitor Cj and the coupling inductor Lj to the isolator, the phase of a transmission signal at the output terminal 15 is ahead of the phase of a transmission signal at the input terminal 14 during forward transmission, whereas the phase of a transmission signal at the input terminal 14 is ahead of the phase of a transmission signal at the output terminal 15 during reverse transmission. The coupling capacitor Cj also advances the phase of a transmission signal regardless of forward transmission or reverse transmission. After the coupling capacitor Cj has been added to the isolator, accordingly, during forward transmission, a signal to be transmitted by magnetic coupling between the central electrodes L1 and L2 and a signal to be transmitted via the coupling capacitor Cj are strengthened by each other, resulting in an increase in the transmission signal as a whole. That is, a forward transmission characteristic with a wide bandwidth and low insertion loss is achieved. This effect becomes pronounced in accordance with an increase in the capacitance of the coupling capacitor Cj.

Consequently, it is not necessary to increase the length of the second central electrode L2 to increase the inductance of the second central electrode L2, resulting in a reduction in the size of the isolator. In addition, since it is not necessary to increase the inductance of the second central electrode L2, it is not necessary to reduce the capacitance value of the resonance capacitor C2 to such an extent that measurement or adjustment of the capacitance value of the resonance capacitor C2 is disabled. Such an isolator thus easily supports a communication system in a high-frequency band exceeding 3000 MHz.

Figure 4:
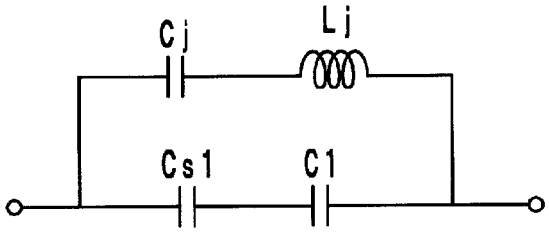
FIG. 4 is a circuit diagram illustrating a parallel resonant circuit including a matching capacitor and a coupling capacitor.

In a relatively high high-frequency frequency band, the central electrode L1 has a high impedance and is therefore substantially electrically open. In this case, a series connection circuit in which the capacitor Cs1 and the capacitor C1 are connected in series is connected in parallel to the series connection circuit of the capacitor Cj and the inductor Lj (see FIG. 4), resulting in a parallel resonant circuit being provided. The parallel resonant circuit has a high impedance around a resonant frequency, and thus a signal to be transmitted around the resonant frequency is significantly reduced. Matching the resonant frequency to a harmonic frequency which requires attenuation achieves a good harmonic attenuation characteristic.

Figure 6A:
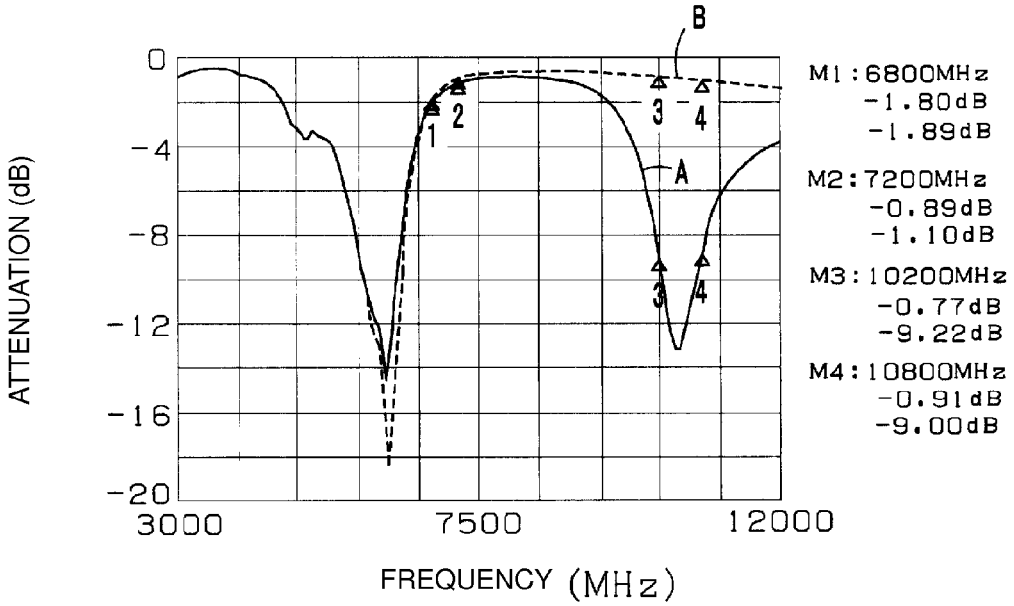
Figure 6B:
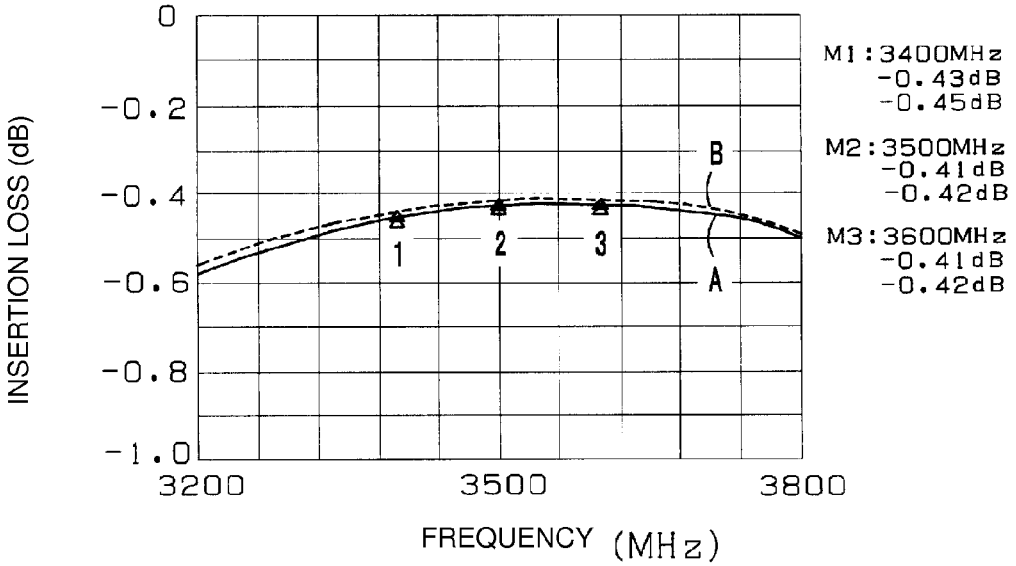

The harmonic attenuation characteristic and the insertion loss characteristic of the isolator 1A according to the first exemplary embodiment described above are indicated by a curved line A in FIG. 6A and a curved line A in FIG. 6B, respectively. Curved lines B in the respective drawings indicate the characteristics in a comparative example in which the coupling inductor Lj is not included.

The characteristics described above are obtained from data of simulation with the following specifications.

Capacitor C1: 1.95 pF
Capacitor C2: 0.45 pF
Capacitor Cs1: 0.80 pF
Capacitor Cs2: 1.55 pF
Resistor R: 320Ω
Inductor Lj: 1 nH
Capacitor Cj: 0.40 pF The isolators 1A, 1B, and 1C are each configured such that only the coupling inductor Lj is added to the isolator described in Japanese Patent No. 4197032, which will not result in a significant increase in the complexity of a circuit or a structure. In addition, around a center frequency at which each of the isolators 1A, 1B, and 1C operates as a non-reciprocal circuit element, the impedance of the coupling inductor Lj is small enough to be negligible, with minor degradation in insertion loss due to the addition of the inductor Lj.

A forward transmission characteristic with a wide bandwidth and low insertion loss is achieved, whereas an isolation characteristic with a narrow bandwidth is achieved. The reason for this is that, during reverse transmission, a reverse signal to be transmitted by magnetic coupling between the central electrodes L1 and L2 and a reverse signal to be transmitted via the coupling capacitor Cj are also strengthened by each other as in forward transmission, resulting in an increase in the reverse transmission signal as a whole. However, the recent specification requirements for isolators have a tendency to emphasize insertion loss over isolation, and an isolation characteristic with a narrow bandwidth often becomes less problematic.

A series connection of the inductor Lj and the capacitor Cj causes the impedance of a circuit to be lower than that in the case where only the capacitor Cj is connected. In order to obtain the same impedance, it is necessary to reduce the capacitance value of the capacitor Cj. Accordingly, in a case where the inductor Lj is connected, the capacitance value of the capacitor Cj is made smaller than that in the case where only the capacitor Cj is connected. In particular, in a case where the capacitor Cj is incorporated into the multilayer substrate 20, the area of a capacitance electrode of the capacitor Cj is reduced, making it possible to reduce the size of the isolator.

Figure 7:
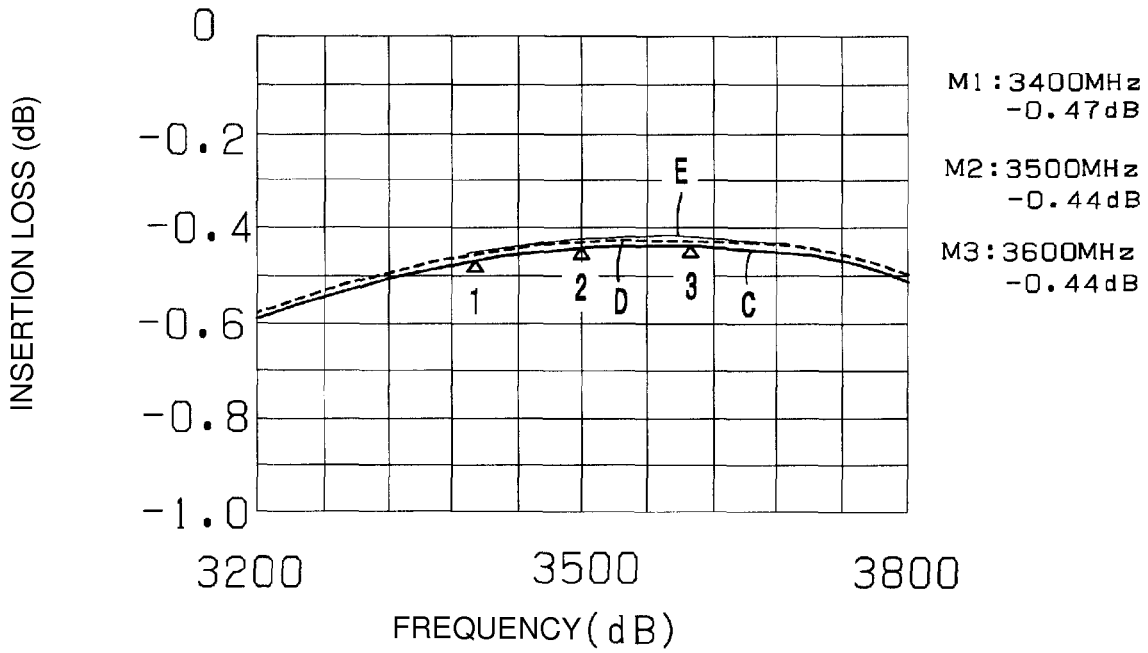
FIG. 7 is a graph illustrating relationships between Q factors of a coupling inductor and insertion loss in the band of 3200 MHz to 3800 MHz.
Figure 8:
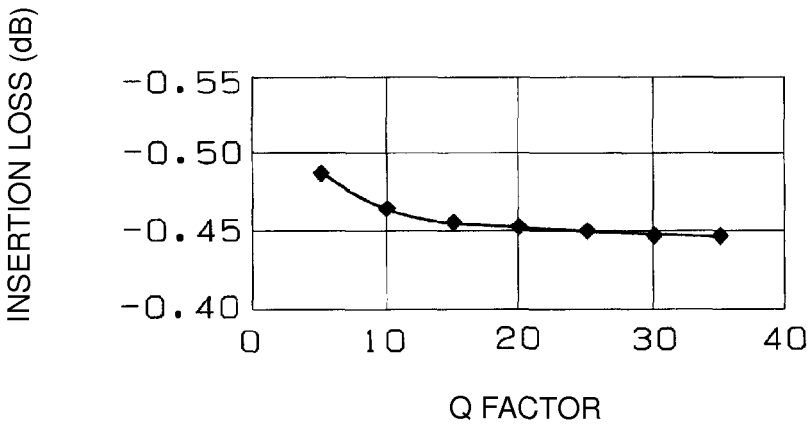
FIG. 8 is a graph illustrating a relationship between the Q factor of the coupling inductor and insertion loss at 3500 MHz.

Next, the Q factor of the coupling inductor Lj in each of the isolators 1A, 1B, and 1C will be described. The Q factor of the inductor Lj is preferably greater than or equal to 10 at an operating center frequency. FIG. 7 illustrates relationships between Q factors of the inductor Lj and insertion loss in the band of 3200 MHz to 3800 MHz, which are indicated by a curved line C for a Q factor of 10, a curved line D for a Q factor of 20, and a curved line E for a Q factor of 30. FIG. 8 illustrates a relationship between the Q factor of the inductor Lj and insertion loss at 3500 MHz. Table 1 given below shows degradations (dB) with respect to the respective Q factors on the basis of the characteristics illustrated in FIG. 8.

TABLE 1

| Lj-Q (3.5 GHz) | Insertion Loss (dB) | Degradation (dB) |
|---|---|---|
| 5 | 0.49 | 0.05 |
| 10 | 0.47 | 0.03 |
| 15 | 0.46 | 0.02 |
| 20 | 0.45 | 0.02 |
| 25 | 0.45 | 0.02 |
| 30 | 0.45 | 0.02 |
| 35 | 0.45 | 0.01 |
| No Lj | 0.43 | 0.00 |

As revealed in Table 1, if the Q factor of the coupling inductor Lj is greater than or equal to 10, the degradation in insertion loss due to the connection of the inductor Lj is less than or equal to 0.03 dB, achieving a low insertion loss characteristic as well as a good harmonic attenuation characteristic.

The coupling capacitor Cj may be configured as a chip-type element. In this case, the capacitor Cj preferably has a self-resonant frequency that is twice or more as high as the operating center frequency. That is, the chip capacitor Cj serves as an inductor at a frequency greater than or equal to the self-resonant frequency, and defines a parallel resonant circuit together with the capacitors Cs1, Cs2, and C1. The parallel resonant circuit has a resonant frequency that is twice or more as high as the center frequency of the isolator. The harmonic attenuation characteristics are generally required in a frequency band of the second harmonic or more.

The configuration described above improves the attenuation in a frequency band of the second harmonic or more. In addition, there is no need for a chip inductor or an electrode pattern to implement the inductor Lj, achieving a reduction in the size and cost of an isolator. Furthermore, the chip capacitor Cj defines and functions as a capacitor at the center frequency of the isolator, making it possible to make an insertion loss characteristic and an isolation characteristic be in a trade-off relationship with each other.

A two-port non-reciprocal circuit element according to the present invention is not limited to those in the exemplary embodiments described above, and a variety of changes can be made within the scope of the present invention.

As described above, exemplary embodiments of the present invention is suitable for use in a two-port non-reciprocal circuit element such as an isolator used in a microwave band, and is advantageous particularly to achieving a good insertion loss characteristic and a good harmonic attenuation characteristic without significantly increasing the complexity of a structure or a circuit.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A two-port non-reciprocal circuit element comprising:

a permanent magnet;

a ferrite to which a direct-current magnetic field is applied by the permanent magnet;

a first central electrode disposed on the ferrite and including an end electrically connected to an input port and another end electrically connected to an output port;

a second central electrode disposed on the ferrite so as to intersect the first central electrode while being electrically insulated from the first central electrode, the second central electrode including an end electrically connected to the output port and another end electrically connected to a ground port;

a first capacitor electrically connected between the input port and the output port;

a resistor electrically connected between the input port and the output port;

a second capacitor electrically connected between the output port and the ground port;

an input terminal;

an output terminal;

a third capacitor electrically connected between the input port and the input terminal;

a first series connection circuit including the first capacitor and the third capacitor which are connected in series; and a second series connection circuit including a coupling capacitor and a coupling inductor which are connected in series between the input terminal and the output port; wherein an impedance matching capacitor is electrically connected between the output port and the output terminal; and the first series connection circuit is connected in parallel to the second series connection circuit.

2. The two-port non-reciprocal circuit element according claim 1, wherein the coupling inductor has a Q factor greater than or equal to 10 at an operating center frequency.

3. The two-port non-reciprocal circuit element according claim 1, wherein a chip capacitor defines the coupling capacitor, and the chip capacitor has a self-resonant frequency that is twice or more as high as an operating center frequency.

4. A two-port isolator comprising the two-port non-reciprocal circuit element according to claim 1.

5. A lumped-constant isolator comprising the two-port non-reciprocal circuit element according to claim 1.

* * * * *